US009368301B2

(12) United States Patent
Campbell et al.

(10) Patent No.: US 9,368,301 B2
(45) Date of Patent: Jun. 14, 2016

(54) VACUUM INTERRUPTER WITH ARC-RESISTANT CENTER SHIELD

(71) Applicant: EATON CORPORATION, Cleveland, OH (US)

(72) Inventors: Louis Grant Campbell, Elmira, NY (US); Stephen David Mayo, Horseheads, NY (US)

(73) Assignee: EATON CORPORATION, Cleveland, OH (US)

( * ) Notice: Subject to any disclaimer, the term of this patent is extended or adjusted under 35 U.S.C. 154(b) by 35 days.

(21) Appl. No.: 14/158,928

(22) Filed: Jan. 20, 2014

(65) Prior Publication Data

US 2015/0206677 A1 Jul. 23, 2015

(51) Int. Cl.

| | |
|---|---|
| ***H01H 33/662*** | (2006.01) |
| ***B22F 1/00*** | (2006.01) |
| ***B22F 3/12*** | (2006.01) |
| ***B22F 3/24*** | (2006.01) |
| ***B22F 7/04*** | (2006.01) |

(Continued)

(52) U.S. Cl.

CPC ..... *H01H 33/66261* (2013.01); *B22F 1/00* (2013.01); *B22F 3/12* (2013.01); *B22F 3/24* (2013.01); *B22F 7/04* (2013.01); *C22C 9/00* (2013.01); *C22C 30/00* (2013.01); *B22F 2003/247* (2013.01); *B22F 2007/042* (2013.01); *H01H 2033/66269* (2013.01); *H01H 2033/66284* (2013.01)

(58) Field of Classification Search

CPC ..... H01H 33/66261; H01H 2003/66269; B22F 3/12; B22F 3/24; B22F 2003/247; B22F 2007/042

USPC ..... 218/130, 131, 132, 136, 150, 147

See application file for complete search history.

(56) References Cited

U.S. PATENT DOCUMENTS 4,020,304 A * 4/1977 Cherry ..... 218/136
4,077,114 A * 3/1978 Sakuma ..... 29/622

(Continued)

FOREIGN PATENT DOCUMENTS

DE 41 35 089 A1 5/1992
JP 2000 057977 A 2/2000

OTHER PUBLICATIONS

Machine translation of JP 2007057977 (original doc. published Feb. 25, 2000).*

(Continued)

*Primary Examiner* — Renee Luebke
*Assistant Examiner* — William Bolton
(74) *Attorney, Agent, or Firm* — Eckert Seamans Cherin & Mellott, LLC; Carol A. Marmo; Grant E. Coffield

(57) ABSTRACT

The disclosed concept pertains to alloy compositions, methods and arc-resistant shields composed of the alloy compositions. The arc-resistant shields are positioned in vacuum interrupter chambers and demonstrate resistance to arc damage and ability to hold off high voltages after arcing, while providing a lower cost alternative to traditional alloy compositions used for producing arc-resistant shields. In certain embodiments, the alloy compositions include copper and/or an element chemically compatible to copper and another component, such as but not limited to, iron, stainless steel, niobium, molybdenum, vanadium, tungsten carbide, chromium carbide, vanadium carbide and chromium, and alloys and mixtures thereof.

13 Claims, 1 Drawing Sheet

(51) Int. Cl.
*C22C 9/00* (2006.01)
*C22C 30/00* (2006.01)

(56) References Cited

U.S. PATENT DOCUMENTS 4,553,007 A 11/1985 Wayland
4,766,274 A * 8/1988 Iyer et al. ..... 218/130
4,940,862 A * 7/1990 Santilli ..... 218/136
5,120,918 A 6/1992 Thomas et al.
5,438,174 A * 8/1995 Slade ..... 218/118
5,753,876 A 5/1998 Lanning

OTHER PUBLICATIONS

European Patent Office, "International Search Report and Written Opinion for PCT/US2014/068986", Mar. 16, 2015, 19 pp.

* cited by examiner

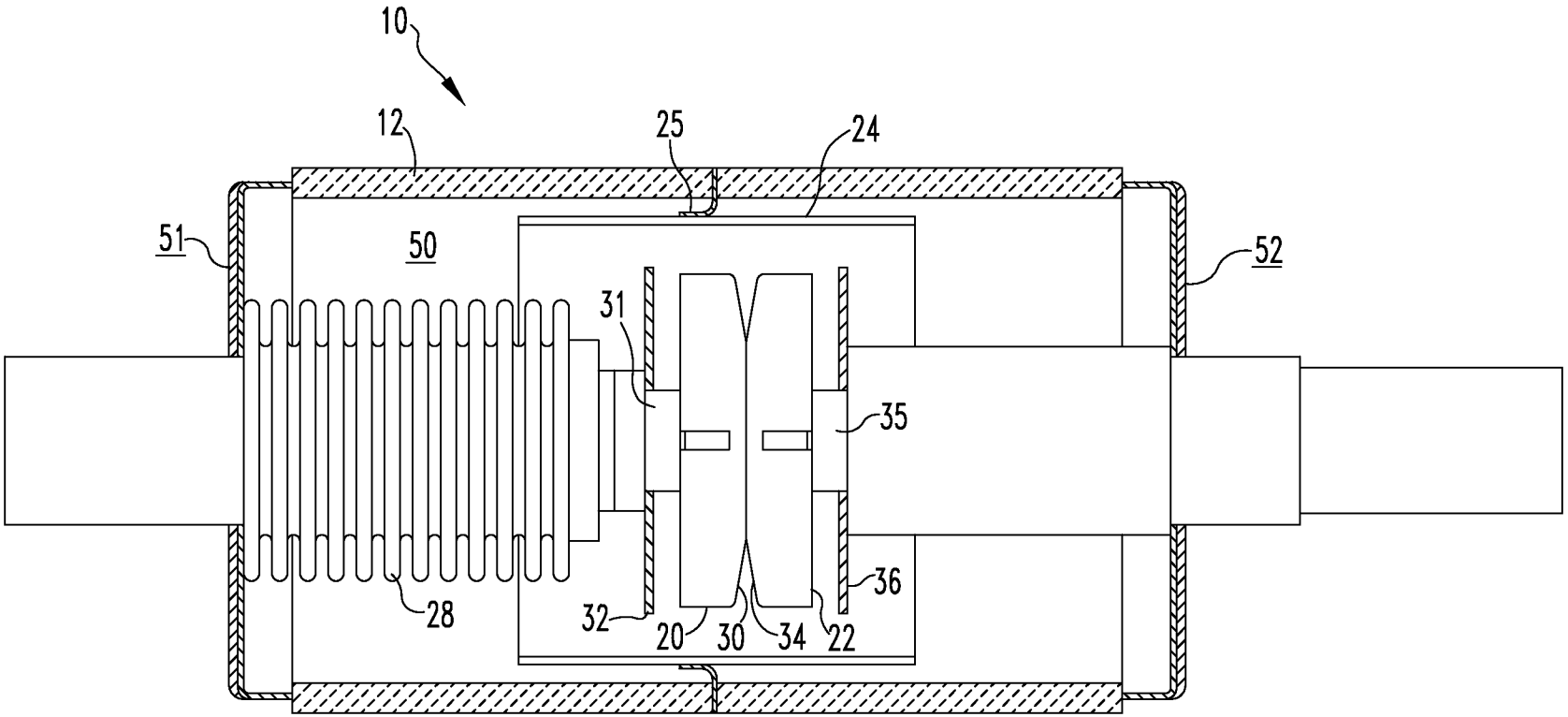
10
12
24
25
50
51
52
35
36
22
34
30
20
31
32
28

VACUUM INTERRUPTER WITH ARC-RESISTANT CENTER SHIELD

BACKGROUND

1. Field

The disclosed concept pertains generally to vacuum circuit breakers and other types of vacuum switchgear and related components, such as vacuum interrupters and arc-resistant shields. In particular, the disclosed concept pertains to new alloy compositions for use in constructing internal arc-resistant shields employed in the vacuum interrupter chamber.

2. Background Information

Vacuum interrupters are typically used to interrupt high voltage AC currents. The interrupters include a generally cylindrical vacuum envelope surrounding a pair of coaxially aligned separable contact assemblies having opposing contact surfaces. The contact surfaces abut one another in a closed circuit position and are separated to open the circuit. Each electrode assembly is connected to a current carrying terminal post extending outside the vacuum envelope and connecting to an AC circuit.

An arc is typically formed between the contact surfaces when the contacts are moved apart to the open circuit position. The arcing continues until the current is interrupted. Metal from the contacts that is vaporized by the arc forms a neutral plasma during arcing and condenses back onto the contacts and also onto a vapor shield placed between the contact assemblies and the vacuum envelope after the current is extinguished.

The vacuum envelope of the interrupter typically includes a ceramic tubular insulating casing with a metal end cap or seal covering each end. The electrodes of the vacuum interrupter extend through the end caps into the vacuum envelope. At least one of the end caps is rigidly connected to the electrode and must be able to withstand relatively high dynamic forces during operation of the interrupter.

Vacuum interrupters are key components of vacuum-type switchgear. It is typical for interrupters for vacuum-type circuit breakers using transverse magnetic field contacts to include the vapor shield, e.g., internal arc shield or arc-resistant shield, that is resistant to heavy arcing to restrict the outward dissemination of the arc and preserve the high voltage withstand of the interrupter after breaking the fault current.

It is customary for the shield to be constructed of copper, stainless steel, copper-chromium alloy or a combination thereof. In some cases, the shield may be constructed of one material in the arcing area and a second material may be used for the remainder of the shield. The copper-chromium alloy material may be used for the highest fault current ratings because of its resistance to arc damage and its ability to hold off high voltages after the arcing has occurred. It is typical for the copper-chromium alloy to include about 10 to 25% by weight chromium and the balance copper.

It is an object of the disclosed concept to develop new alloy compositions for use in constructing arc-resistant shields for internal use in vacuum interrupters wherein the compositions are other than the conventional pure chromium and copper alloys. It is a further object to develop new alloy compositions wherein the amount of chromium is present in a reduced amount as compared to known copper-chromium compositions. In still a further object, chromium is absent from the compositions. Chromium is expensive to obtain and therefore, reducing or eliminating the presence of chromium will provide a lower cost alternative to the conventional materials used in constructing arc-resistant shields. Further, it is believed employing materials or elements other than pure chromium and copper can result in alloy compositions which exhibit superior performance in arc-resistant shields.

SUMMARY

These needs and others are met by embodiments of the disclosed concept, which provide compositions and arc-resistant shields constructed of these compositions.

In an aspect, the disclosed concept provides an alloy composition for constructing an arc-resistant shield positioned in a vacuum interrupter chamber. The alloy composition includes a melting range of 100° C. or greater between a solidus temperature and a liquidus temperature, the solidus temperature of 900° C. or greater, a substantially multi-phase microstructure, and an ability to form a substantially smooth surface when rapidly cooled following arc melting.

The composition can include a first component and a second component. The first component may include copper or a chemically compatible element to copper. The second component may be selected from the group consisting of iron, stainless steel, niobium, molybdenum, vanadium, chromium alloy, carbide, and alloys and mixtures thereof. In certain embodiments, the composition includes the copper component and ferrochrome. The ferrochrome may constitute about 70 weight percent chromium and about 30 weight percent iron.

The first component may be pure copper or a copper alloy, such as but not limited to cupronickel, copper-tin, nickel-copper, silver bearing copper, tin bronze and aluminum bronze. The first component can also include nickel, silver, gold, palladium, platinum, cobalt, rhodium, iridium, ruthenium, and alloys and mixtures thereof.

The carbide may be selected from the group consisting of tungsten carbide, chromium carbide, vanadium carbide, molybdenum carbide, niobium carbide, tantalum carbide, titanium carbide, zirconium carbide, hafnium carbide, boron carbide, and silicon carbide.

In another aspect, the disclosed concept provides an arc-resistant shield composed of an alloy material including a first component and a second component. The first component may include copper or a chemically compatible element to copper. The second component may be selected from the group consisting of iron, stainless steel, niobium, molybdenum, vanadium, chromium alloy, carbide, and their alloys and mixtures. The arc-resistant shield is an internal component of a vacuum interrupter.

In certain embodiments, the first component may include pure copper or copper alloy. In other embodiments, the first component may include nickel, silver, gold, palladium, platinum, cobalt, rhodium, iridium, ruthenium, and alloys and mixtures thereof.

In still another aspect, the disclosed concept provides a method for preparing an arc-resistant shield located in a vacuum interrupter. The method includes obtaining a first component selected from the group consisting of pure copper, copper alloy, a chemically compatible element to copper and mixtures thereof; obtaining a second component selected from the group consisting of iron, stainless steel, niobium, molybdenum, vanadium, chromium alloy, carbide, and their alloys and mixtures; combining the first and second components to form a mixture, shaping the mixture into a selected shape; and machining to form the arc-resistant shield. The chromium alloy may be ferrochrome and the ferrochrome may be in the form of a pre-alloyed chromium-iron powder.

Further, the forming of the mixture may be conducted by a technique selected from extruding, molding and combinations thereof.

BRIEF DESCRIPTION OF DRAWINGS

A full understanding of the disclosed concept can be gained from the following description of the preferred embodiments when read in conjunction with the accompanying drawing in which:

FIG. 1 is a sectional view of a vacuum interrupter including an arc-resistant shield, in accordance with the disclosed concept.

DETAILED DESCRIPTION OF PREFERRED EMBODIMENTS

The disclosed concept includes alloy compositions, methods of preparing the compositions and methods of employing the compositions to prepare arc-resistant shields for use in vacuum interrupters. Vacuum interrupters are key internal components of vacuum switchgear, such as vacuum circuit breakers. The arc-resistant shields are traditionally constructed of copper, stainless steel or copper-chromium alloy. In particular, copper-chromium alloys are known materials for use with highest fault current ratings because of their resistance to heavy arcing and their ability to preserve the high voltage withstand of the interrupter after arcing has occurred. Preferred copper-chromium alloys include from 10 to 25 weight percent chromium and the balance copper based on total weight of the alloy composition. One disadvantage of known copper-chromium alloys is the high cost associated with them. In particular, pure chromium is an expensive element and therefore, its presence in an alloy composition can result in an expensive material. The cost of a material may be lowered by reducing the amount of chromium or producing the material in the absence of chromium. Thus, it is an object of this disclosed concept to provide suitable alloy compositions that are useful in forming arc-resistant shields. The alloy compositions should be capable of demonstrating resistance to arc damage and holding off high voltages after arcing, while providing lower cost alternatives to traditional alloy compositions.

FIG. 1 shows a vacuum interrupter 10 having a cylindrical insulating tube 12 which, in combination with end seals 51 and 52, forms a vacuum envelope 50. The insulating tube 12 supports a vapor shield 24 by means of a flange 25. An arc resistant vapor shield 24 surrounds a first electrode assembly 20 and a second electrode assembly 22 to prevent metal vapors from collecting on the insulating tube 12 and to prevent the arc from hitting the insulating tube 12. The insulating tube 12 is preferably made of a ceramic material such as alumina, zirconia or other oxide ceramics, but may also be glass. The first and second electrode assemblies 20 and 22, respectively, are longitudinally aligned within the vacuum envelope 50. The first electrode assembly 20 includes a bellows 28, a first electrode contact 30, a first terminal post 31, and a first vapor shield 32. The second electrode assembly 22 includes a second electrode contact 34, a second terminal post 35, and a second vapor shield 36. While the vacuum envelope 50 shown in FIG. 1 is part of the vacuum interrupter 10, it is to be understood that the term "vacuum envelope" as used herein is intended to include any sealed component having a ceramic to metal seal which forms a substantially gas-tight enclosure. Such sealed enclosures may be maintained at sub-atmospheric, atmospheric or super-atmospheric pressures during operation.

The first and second electrode assemblies 20 and 22, respectively, are axially movable with respect to each other for opening and closing the AC circuit. The bellows 28 mounted on the first electrode assembly 20 seals the interior of the vacuum envelope formed by the insulating tube 12 and end seals 51 and 52, while permitting movement of the first electrode assembly 20 from a closed position as shown in FIG. 1 to an open circuit position (not shown). The first electrode contact 30 is connected to the generally cylindrical first terminal post 31 which extends out of the vacuum envelope 50 through a hole in the end seal 51. The first vapor shield 32 is mounted on the first terminal post 31 in order to keep metal vapors off the bellows 28. Likewise, the second electrode contact 34 is connected to the generally cylindrical second terminal post 35 which extends through the end seal 52. The second vapor shield 36 is mounted on the second terminal post 35 to protect the insulating tube 12 from metal vapors. The second terminal post 35 is rigidly and hermetically sealed to the end seal 52 by means such as, but not limited to, welding or brazing.

Preferably, said first and second electrode contacts 30 and 34, respectively, are composed of an alloy composition, e.g., copper-chromium.

In accordance with certain embodiments of the disclosed concept, suitable alloy compositions for producing an arc-resistant shield demonstrate one or more of the following characteristics or properties:

(i) melting range or interval wherein solid and liquid phases simultaneously exist, e.g., a slurry, and wherein the melting range or interval is equal to or greater than 100° C. between solidus and liquidus temperatures;

(ii) solidus temperature equal to or greater than 900° C.;

(iii) substantially multi-phase microstructure with at least two phases; and (iv) ability to form a substantially smooth surface when rapidly cooled after arc melting.

The disclosed concept relates to an alloy composition having a first component and a second component. In certain embodiments, the first component is copper, including pure copper, copper alloy or mixtures thereof. In certain embodiments, instead of or in addition to, the first component may include any compatible element. For example, any element that is chemically compatible to copper. That is, an element that may serve as a replacement for copper. Suitable compatible elements include but are not limited to nickel, silver, gold, palladium, platinum, cobalt, rhodium, iridium, ruthenium, and alloys and mixtures thereof. The second component may include iron, stainless steel, niobium, molybdenum, vanadium, chromium, carbide and alloys and mixtures thereof. The carbide may include tungsten carbide, chromium carbide, vanadium carbide, molybdenum carbide, niobium carbide, tantalum carbide, titanium carbide, zirconium carbide, hafnium carbide, boron carbide and silicon carbide. In certain embodiments, the second component is chromium alloy.

Non-limiting examples of alloy compositions that are suitable for use in the disclosed concept include a copper component with another component such as, iron, stainless steel, niobium, molybdenum, vanadium, chromium, their alloys or mixtures, and carbide. In certain embodiments of the disclosed concept, the alloy compositions include copper-iron, copper-stainless steel, copper-niobium, copper-molybdenum, copper-vanadium, copper-chromium alloy, copper-ferrochrome, copper-ferrovanadium, copper-ferroniobium, and copper-X-carbide wherein X represents tungsten, chromium, vanadium, tantalum, molybdenum, niobium, silicon, boron, or any common carbide former. Further, in certain embodiments, the copper alloy can include cupronickel, copper-tin, nickel-copper, silver bearing copper, tin bronze and aluminum bronze.

The disclosed concept relates to alloy compositions for producing the arc-resistant shield that include components other than pure chromium since the use of pure chromium can result in an expensive material. In certain embodiments, the compositions include copper, e.g., in the form of pure copper and/or copper alloy, and a chromium alloy wherein the chromium alloy is ferrochrome. The amount of each of these components can vary. The ferrochrome may constitute from about 5 to about 60 weight percent based on total weight of the composition. The copper may constitute the balance. The ferrochrome component is a chromium-iron alloy wherein the amount of each of the chromium and iron can vary. The chromium may constitute about 70 weight percent and the iron may constitute about 30 weight percent based on total weight of the ferrochrome component.

In general, the alloy compositions of the disclosed concept are subjected to one or more of known powder metallurgy, extrusion, forging and casting processes in order to form an arc-resistant shield. Traditional powder metallurgy techniques include but are not limited to pressing and sintering, extrusion, e.g., binder-assisted extrusion, powder injection molding and powder forging. Extrusion includes hot or cold extrusion and forging includes hot forging or cold forming. Casting includes vacuum induction melting, sand casting, and other conventional casting methods.

In accordance with certain embodiments of the disclosed concept, each of the copper and ferrochrome components may be in dry form, e.g., powder. In these embodiments, the composition is prepared by mixing together copper powder and ferrochrome powder. The ferrochrome powder constitutes a pre-alloyed chromium-iron powder. The amounts of copper and ferrochrome, and the amounts of chromium and iron can be within the weight ranges specified above. The copper and ferrochrome powders may be atomized, chemically reduced, electrolytically formed, ground or formed by any other known powder production process. The powder morphology may be spherical, acicular, or irregular. The copper-ferrochrome powder mixture is pressed to shape and sintered. The shaping and sintering can be conducted in accordance with conventional shaping and sintering apparatus and processes known in the art. The shaped, sintered article forms an arc-resistant shield. Optionally, machining of the shaped, sintered article may be necessary to finalize the form of the shield.

In a preferred method of fabricating the arc-resistant shield for the vacuum circuit interrupter, the steps of fabricating include pouring a copper-ferrochrome blend into a die cavity, tapping to level powder, applying a pressure of about 80,000 to about 150,000 psi to form a shield, sintering the shield in a reducing or vacuum furnace at a temperature of about 950° C. to about 1100° C. for about 0.5 to about 10 hours, and machining and forming a hollow shield.

In a preferred method, the steps include initially prefabricating a cylindrical shell container or tube container of copper, or copper alloy, pouring copper-ferrochrome powder, leveling by tapping or pressing, outgassing the container containing the powder at a temperature of about 125° C. to about 400° C., sealing the container by welding a top cover of the container vacuum weld or welding the top; evacuating through a port and seal, hot extruding the container at a temperature from about 400° C. to about 900° C., removing the container and machining the shields. In another form of the method, the container is hot isostatically pressed in the range of about 700° C. to about 1080° C., between about 10,000 psi to about 30,000 psi for about 0.25 hours to about 6 hours.

Various processes for the fabrication of the shield include the following:

Process #1

1. Pour a copper-ferrochrome blend into a die cavity and tap to level powder;

2. Apply a pressure of about 80,000 to about 150,000 psi to fabricate a shield pre-form;

3. Sinter in a reducing or vacuum furnace in a range of about 950° C. to about 1100° C. for about 0.5 to about 10 hours; and 4. Machine the shield by boring out the center.

Process #2

1. Same as Process #1 except that a core is used in the die during pressing to form a hollow tube pre-form;

2. Sinter in a reducing or vacuum furnace in a range of about 950° C. to about 1100° C. for about 0.5 to about 10 hours; and 3. Machine the shield.

Process #3

1. Same as Processes #1 and #2 except that a rubber bag is used as the die and a cold isostatic press is used to apply isostatic pressure in a range of about 60,000 psi to about 120,000 psi;

2. Sinter in a reducing or vacuum furnace in a range of about 950° C. to about 1100° C. for about 0.5 to about 10 hours; and 3. Machine the shield.

Process #4

1. Place a prefabricated copper or copper-ferrochrome pipe;

2. Plasma, laser deposit, thermal spray, or cold spray a layer of copper-ferrochrome on the internal diameter of the pipe; and 3. Machine the shield.

Process #5

1. Place a sacrificial or re-usable mandrel;

2. Plasma, laser deposit, thermal spray, or cold spray a layer of copper-ferrochrome on the outside diameter of the mandrel;

4. Remove the mandrel by machining (or chemically if sacrificial), or withdraw the mandrel from the deposited material if re-usable; and 3. Machine the shield.

Process #6

1. Form a slurry of copper powder, ferrochrome powder, and a suitable liquid carrying agent (binder) that substantially solidifies when dried or centrifugally separated;

2. Pour the slurry into a hollow pipe;

3. Spin the pipe to force the slurry against the inner diameter of the pipe;

4. Dry the spun mixture;

5. Remove the solidified mixture from the pipe;

7. Sinter the centrifugally formed cylindrical powder mixture; and

8. Machine the shield from the cylindrical sintered part.

Process #7

1. Melt an appropriate mixture of copper and ferrochrome using vacuum induction melt or other technique;

2. Pour the melt into a mold with a central core;

3. Break out the mold to remove the casting; and

4. Machine the casting to form a shield.

Process #8

1. Melt an appropriate mixture of copper and ferrochrome using vacuum induction melt or other technique;

2. Pour the melt into a mold with a centrifugal caster and cast the shield; and

3. Machine the shield.

Process #9

1. Prepare a solid or cylindrical blank of copper and ferrochrome by powder metallurgy sintering, powder metallurgy infiltration, or casting;

2. Heat the blank to a temperature at which it may be extruded;

3. Extrude the blank into a cylindrical shape, e.g., using an extrusion press; and 4. Machine the shield from the extruded cylindrical shape, if necessary.

Process #10

1. Mix dry copper and ferrochrome powder with a suitable plastic binder system;

2. Heat the powder/binder mixture to a temperature at which it may be molded;

3. Extrude or powder injection mold the powder/binder mixture into a cylindrical shape;

4. Remove the plastic binder system by solvent process, thermal process, or a combination thereof, such that the powder remains in its formed cylindrical shape;

5. Sinter the cylindrical shape; and

6. Machine the shield, if necessary.

EXAMPLES

Example 1

In one experiment, arc resistant shields were made by mixing 36 wt % high carbon ferrochrome powder and 64 wt % copper powder, pressing in a cylindrical die, sintering the part, and machining the final shield shape. The composition of the high carbon ferrochrome powder was 67-71 wt % chromium, 8-9.5% carbon, with the balance iron. The high carbon ferrochrome powder was ground to a size of −100 mesh. The copper powder was water atomized pure copper, at a size of −140 mesh. Pressing of the parts was performed with a dual-action powder compaction press. The tooling elements used to press the cylindrical parts consisted of a hollow cylindrical upper punch, hollow cylindrical lower punch, hollow cylindrical die body, and a solid cylindrical core rod. Powder was fed into the cylindrical cavity using an automatic powder shoe. Compaction was performed at pressures of 45,000 to 116,000 psi. Parts were then vacuum sintered at 950 to 1050° C. for 6 hours and machined on a lathe to final shape.

Example 2

In another experiment, arc resistant shields were made by mixing 60 wt % high carbon ferrochrome powder and 40 wt % copper powder, pressing in a cylindrical die, sintering the part, and machining the final shield shape. The composition of the high carbon ferrochrome powder was 67-71 wt % chromium, 8-9.5% carbon, with the balance iron. The high carbon ferrochrome powder was ground to a size of −100 mesh. The copper powder was water atomized pure copper, at a size of −140 mesh. Pressing of the parts was performed with a dual-action powder compaction press. The tooling elements used to press the cylindrical parts consisted of a hollow cylindrical upper punch, hollow cylindrical lower punch, hollow cylindrical die body, and a solid cylindrical core rod. Powder was fed into the cylindrical cavity using an automatic powder shoe. Compaction was performed at pressures of 60,000 to 160,000 psi. Parts were then vacuum sintered at 950 to 1050° C. for 6 hours, and machined on a lathe to final shape.

Example 3

In another experiment, arc resistant shields were made by mixing 36 wt % low carbon ferrochrome powder and 64 wt % copper powder, pressing in a cylindrical die, sintering the part, and machining the final shield shape. The composition of the high carbon ferrochrome powder was 70 wt % chromium with the balance iron. The high carbon ferrochrome powder was ground to a size of −80 mesh. The copper powder was water atomized pure copper, at a size of −140 mesh. Pressing of the parts was performed with a dual-action powder compaction press. The tooling elements used to press the cylindrical parts consisted of a hollow cylindrical upper punch, hollow cylindrical lower punch, hollow cylindrical die body, and a solid cylindrical core rod. Powder was fed into the cylindrical cavity using an automatic powder shoe. Compaction was performed at pressures of 43,000 to 119,000 psi. Parts were then vacuum sintered at 950 to 1050° C. for 6 hours, and machined on a lathe to final shape.

Example 4

In another experiment, arc resistant shields were made by mixing 60 wt % low carbon ferrochrome powder and 40 wt % copper powder, pressing in a cylindrical die, sintering the part, and machining the final shield shape. The composition of the high carbon ferrochrome powder was 70 wt % chromium with the balance iron. The high carbon ferrochrome powder was ground to a size of −80 mesh. The copper powder was water atomized pure copper, at a size of −140 mesh. Pressing of the parts was performed with a dual-action powder compaction press. The tooling elements used to press the cylindrical parts consisted of a hollow cylindrical upper punch, hollow cylindrical lower punch, hollow cylindrical die body, and a solid cylindrical core rod. Powder was fed into the cylindrical cavity using an automatic powder shoe. Compaction was performed at pressures of 50,000 to 112,000 psi. Parts were then vacuum sintered at 950 to 1050° C. for 6 hours, and machined on a lathe to final shape.

While example systems, methods, and the like have been illustrated by describing examples, and while the examples have been described in considerable detail, it is not the intention of the applicants to restrict or in any way limit the scope of the appended claims to such detail. It is, of course, not possible to describe every conceivable combination of components or methodologies for purposes of describing the systems, methods, and so on described herein. Therefore, the disclosed concept is not limited to the specific details, the representative apparatus, and illustrative examples shown and described. Thus, this application is intended to embrace alterations, modifications, and variations that fall within the scope of the appended claims.

What is claimed is:

1. An alloy composition for constructing an arc-resistant shield positioned in a vacuum switchgear chamber, the alloy composition comprising:

(i) first component selected from the group consisting of pure copper, copper alloy and mixtures thereof, and a second component having at least one element selected from the group consisting of iron, stainless steel, niobium, molybdenum, vanadium and carbide, said first and second components having an absence of chromium; or (ii) a copper component selected from the group consisting of pure copper, copper alloy and mixtures thereof, and a chromium alloy component selected from the group consisting of iron-chromium and chromium-carbide;

a melting range of 100° C. or greater between a solidus temperature and a liquidus temperature;

the solidus temperature of 900° C. or greater;

a multi-phase microstructure; and an ability to form a smooth surface when rapidly cooled following arc melting, wherein pure chromium is excluded as a component of the alloy composition.

2. The composition of claim 1, wherein the copper alloy is selected from the group consisting of cupronickel, copper-tin, nickel-copper, silver bearing copper, tin bronze and aluminum bronze.

3. The composition of claim 1, wherein the carbide is selected from the group consisting of tungsten carbide, vanadium carbide, molybdenum carbide, niobium carbide, tantalum carbide, titanium carbide, zirconium carbide, hafnium carbide, boron carbide and silicon carbide.

4. The composition of claim 1, wherein the iron-chromium alloy is ferrochrome.

5. The composition of claim 4, wherein the ferrochrome constitutes from about 5 to about 60 weight percent based on total weight of the composition.

6. The composition of claim 4, wherein the ferrochrome is in a form of pre-alloyed powder.

7. The composition of claim 4, wherein the ferrochrome constitutes about 70 weight percent chromium and about 30 weight percent iron based on total weight of the ferrochrome component.

8. The composition of claim 1, further comprising a chemically compatible element selected from the group consisting of nickel, silver, gold, palladium, platinum, cobalt, rhodium, iridium, ruthernium, and alloys and mixtures thereof.

9. An arc-resistant shield composed of an alloy material comprising:

(i) a first component selected from the group consisting of pure copper, copper alloy, a chemically compatible element to copper, and mixtures thereof, and a second component having at least one element selected from the group consisting of iron, stainless steel, niobium, molybdenum, vanadium and carbide, said first and second components having an absence of chromium; or (ii) a copper component selected from the group consisting of pure copper, copper alloy and mixtures thereof, and a chromium alloy component selected from the group consisting of iron-chromium and chromium-carbide, wherein, pure chromium is excluded as a component of the alloy material, and wherein, the arc-resistant shield is an internal component of a switchgear contained in a vacuum chamber.

10. A method for preparing an arc-resistant shield located in a vacuum switchgear chamber, the method comprising:

obtaining an alloy composition, comprising:

(i) a first component selected from the group consisting of pure copper, copper alloy, a chemically compatible element to copper and mixtures thereof, and a second component having at least one element selected from the group consisting of iron, stainless steel, niobium, molybdenum, vanadium and carbide, said first and second components having an absence of chromium; or (ii) a copper component selected from the group consisting of pure copper, copper alloy and mixtures thereof, and a chromium alloy component selected from the group consisting of iron-chromium and chromium-carbide;

combining the first and second components to form a mixture, wherein, pure chromium is excluded as a component of the mixture;

shaping the mixture into a selected shape; and machining to form the arc-resistant shield.

11. The method of claim 10, wherein the chromium alloy is ferrochrome.

12. The method of claim 11, wherein the ferrochrome is in a form of pre-alloyed chromium-iron powder.

13. The method of claim 10, wherein the forming of the mixture is conducted by a technique selected from the group consisting of extruding, molding and combinations thereof.

* * * * *